US009303489B2

(12) United States Patent
Salen et al.

(10) Patent No.: US 9,303,489 B2
(45) Date of Patent: Apr. 5, 2016

(54) SUBSEA CONTROL MODULES AND METHODS RELATED THERETO

(75) Inventors: Asgeir Salen, Knarrevik (NO); Bjørn Endresen, Flatåsen (NO)

(73) Assignee: SUBC SOLUTIONS AS, Knarrevik (NO)

( * ) Notice: Subject to any disclaimer, the term of this patent is extended or adjusted under 35 U.S.C. 154(b) by 0 days.

(21) Appl. No.: 14/241,857

(22) PCT Filed: Aug. 31, 2012

(86) PCT No.: PCT/NO2012/050158
§ 371 (c)(1),
(2), (4) Date: May 19, 2014

(87) PCT Pub. No.: WO2013/032344
PCT Pub. Date: Mar. 7, 2013

(65) Prior Publication Data

US 2014/0305656 A1 Oct. 16, 2014

(30) Foreign Application Priority Data

Sep. 2, 2011 (NO) ..... 20111200

(51) Int. Cl.
*E21B 41/00* (2006.01)
*E21B 33/035* (2006.01)

(52) U.S. Cl.
CPC ..... *E21B 41/0007* (2013.01); *E21B 33/0355* (2013.01)

(58) Field of Classification Search
CPC ..... E21B 41/0007; E21B 33/0355
USPC ..... 166/351, 336, 344, 363, 364, 368, 373; 137/236.1, 250, 825, 635, 554, 557; 251/1.1, 1.3
See application file for complete search history.

(56) References Cited

U.S. PATENT DOCUMENTS

| | | | | |
|---|---|---|---|---|
| 4,027,286 | A * | 5/1977 | Marosko | 340/13.33 |
| 4,880,025 | A * | 11/1989 | McMahan et al. | 137/1 |
| 5,295,547 | A * | 3/1994 | Coelho et al. | 166/368 |
| 6,068,427 | A * | 5/2000 | Østergaard | 405/191 |
| 6,938,695 | B2 * | 9/2005 | Williams | 166/341 |
| 2009/0038805 | A1 | 2/2009 | Parks et al. | |
| 2011/0266002 | A1 * | 11/2011 | Singh et al. | 166/339 |
| 2014/0321341 | A1 * | 10/2014 | Kristiansen | 370/297 |

FOREIGN PATENT DOCUMENTS

| | | | |
|---|---|---|---|
| GB | 2 458 944 | A | 10/2009 |
| GB | 2 477 714 | A | 8/2011 |
| WO | WO 2009/138849 | A1 | 11/2009 |

OTHER PUBLICATIONS

International Preliminary Report on Patentability dated Mar. 4, 2014 for PCT Application No. PCT/NO2012/050158, filed Aug. 31, 2012.
International Search Report and Written Opinion of the International Searching Authority dated Oct. 23, 2013 for PCT Application No. PCT/NO2012/050158, filed Aug. 31, 2012.

* cited by examiner

*Primary Examiner* — James G Sayre
(74) *Attorney, Agent, or Firm* — Knobbe Martens Olson & Bear LLP

(57) ABSTRACT

The present invention relates to subsea control modules (SCMs). According to an aspect of the invention, there is provided a subsea control module (10) comprising a hydraulic manifold (12) and two separately retrievable subsea electronic modules (24*a*, 24*b*). The present invention also relates to a method of maintaining a subsea control module, and to a method of modifying an existing subsea control module.

20 Claims, 4 Drawing Sheets

SUBSEA CONTROL MODULES AND METHODS RELATED THERETO

CROSS REFERENCE TO RELATED APPLICATIONS

This application is a U.S. National Phase Application of PCT International Application No. PCT/NO2012/050158, filed on Aug. 31, 2012, designating the United States of America and published in the English language, which claims priority to Norwegian Application No. 20111200, filed Sep. 2, 2011. The disclosures of the above-referenced applications are hereby expressly incorporated by reference in their entireties.

The present invention relates to subsea control modules (SCMs). The present invention also relates to a method of maintaining a subsea control module, and to a method of modifying an existing subsea control module.

A prior art subsea control module (SCM) 100 is illustrated in FIG. 1. The SCM 100 comprises a hydraulic manifold 102 and two subsea electronic modules (SEMs) 104*a* and 104*b* for redundancy or duplicity. The hydraulic manifold 102 includes directional control valves (DCVs) and sensors. The hydraulic manifold 102 and the two SEMs 104*a-b* are placed within a housing 106 which is filled with a dielectric fluid, such as oil. The hydraulic manifold 102 and the two SEMs 104*a-b* are interconnected with a large number of wires/connections 108 (typically >100 wires/connections).

However, if one of the SEMs 104*a-b* needs repair or modification, this requires retrieval of the complete SCM 100, which may have a weight of more than 2000 kg. Retrieval of the SCM 100 may be a complex, time consuming, and costly operation. Also, the associated subsea well must be shut down (closed down), which further increases the cost.

Further, GB2405163 (VETCO GRAY CONTROLS LTD) discloses a control system which comprises one subsea electronic module and two hydraulic power switching modules which contain equipment to effect limited hydraulic functions, such as the control of DCVs, actuators etc. The SEM sends control signals to the hydraulic modules via electrical jumpers. Supposedly, the SEM, the hydraulic modules, and the jumpers may all be removed and replaced by using an ROV. However, if the SEM needs to be replaced, the associated well needs to be shut down.

U.S. Pat. No. 6,644,410 (Lindsey-Curran, et al.) relates to a modular control system having a housing and inner modules, for use with subsea installations or for use in harsh weather conditions such as on oil and gas rigs wherein one or more of the inner modules may be removed and replaced without having to shut down the entire control system. The inner module may be an electronic module.

U.S. Pat. No. 4,027,286 (Marosko) discloses a multiplexed data monitoring system including control valves, switches used to indicate the state of the valves and interconnected with a passive encoder, and a retrievable control module with an active decoder. Commands transmitted to the control module and through electrical interconnections may cause the valves to operate. The principal advantages of the circuit are supposedly that multiple bits of status information can be transferred using only a single pair of conductors and that no external power is required to encode this data. However, as mentioned above, retrieving a whole control module is a complex, time consuming, and costly operation.

US2005241410 (Wium) discloses a subsea multiphase flow meter sensor housing, comprising a flow tubular housing and a retrievable canister, adapted to be removably attached to the flow tubular housing and to house electronics. The device disclosed in US2005241410 is not a subsea control module.

It is an object of the present invention to at least partly overcome one or more of the above-mentioned drawbacks, and to provide an improved subsea control module.

This, and other objects that will be apparent from the following description, is achieved by subsea control modules and methods according to the appended independent claims. Embodiments are set forth in the appended dependent claims.

According to an aspect of the present invention, there is provided a subsea control module comprising a hydraulic manifold and two separately retrievable subsea electronic modules.

By having two separately retrievable subsea electronic modules, it is not necessary to retrieved the complete subsea control module from a subsea location if one of the subsea electronic modules fails. Instead, only the failed subsea electronic module can be retrieved. Since the subsea electronic module typically is significantly smaller and lighter than the complete subsea control module, retrieving only the subsea electronic module instead of the complete subsea control module is a simpler, less time consuming, and less expensive operation.

The subsea control module may be configured to operate using only one or both of the two subsea electronic modules. That is, when the failed subsea electronic module is retrieved, operation of the subsea control module may be continued using the other subsea electronic module, and it is not necessary to shut down the associated subsea well. The overall, OPEX costs can be reduced without change in functionality, and increased oil recovery may be achieved.

The subsea electronic modules may be adapted for removal and mounting by a remotely operated vehicle (ROV). Alternatively, the subsea electronic modules may be removed/mounted by a diver and a tugger, or by use of other tools, for example.

The subsea control module may further comprise an outer housing, wherein the hydraulic manifold is arranged at least partly inside the outer housing, and wherein the subsea electronic modules are removably attached outside the outer housing.

The subsea control module may further comprise logic adapted to de-multiplex signals or data from the subsea electronic modules to components of the hydraulic manifold. In one embodiment, the logic is further adapted to multiplex signals or data from (other) components of the hydraulic manifold to the subsea electronic modules. That is, the logic allows two-way (multiplexed) communication between the subsea electronic modules and the components of the hydraulic manifold. In this way, fewer connections between the subsea electronic modules and the components of the hydraulic manifold are necessary. The communication may for example be frequency multiplexed or time multiplexed.

The logic may be arranged in or inside the outer housing.

Further, the logic may consist of discrete circuits. Discrete circuits are typically very reliable, and no software is needed.

Further, the components may include valves and sensors. The valves and sensors of the present subsea control module may be of the same type as the valves and sensors used in existing subsea control modules.

Further, the logic for each subsea electronic module may comprise at least one multiplexer adapted to multiplex several inputs from the sensors to fewer inputs for the subsea electronic module, and at least one de-multiplexer adapted to de-multiplex at least one input from the subsea electronic module to more outputs for the valves.

The subsea electronic modules may be connected by wet mate connectors. Wet mate connectors can be connected and disconnected under water, for example using an ROV. Current wet mate connectors have a sufficient number of pins to allow a large number of valves and sensors to be controlled and read off when the communication over the connectors is multiplexed using the above described logic.

Further, a quick dump valve may be directly connected to the subsea electronic modules via the wet mate connectors, thereby bypassing the logic. In this way, safety functions are not compromised despite the use of the above described logic.

Further, a production master valve or production wing valve may be directly connected to the subsea electronic modules via the wet mate connectors, thereby bypassing the logic.

In another embodiment, wherein the subsea control module comprises logic 20*c* adapted to de-multiplex signals or data from the subsea electronic modules to components of the hydraulic manifold, other components of the hydraulic valve may include bus sensors directly connected to the subsea electronic modules via at least one wet mate connector. In this embodiment, the logic needs not to be adapted to multiplex signals or data to the subsea electronic modules as with discrete sensors.

According to another aspect of the present invention, there is provided a method of maintaining a subsea control module according to the above description, which method comprises: removing one of the retrievable subsea electronic modules while the subsea control module is operated at a subsea location using the other subsea electronic module; and mounting the removed subsea electronic module (which has been repaired and/or upgraded) or another retrievable subsea electronic module to the subsea control module still at the subsea location. The removal and mounting may for instance be performed using an ROV. This aspect may exhibit the same or similar technical effects and features as the previously described aspect of the invention, and vice versa.

According to another aspect of the present invention, there is provided a subsea control module, comprising: an outer housing; a hydraulic manifold arranged inside the outer housing; and means for connecting two separately retrievable subsea electronic modules on the outside of the outer housing. Said means may include wet mate connectors, but can also include additional fastening means. This aspect may exhibit the same or similar technical effects and features as the previously described aspects of the invention, and vice versa.

According to another aspect of the present invention, there is provided a method of modifying an existing subsea control module, the existing subsea control module comprising a hydraulic manifold and at least one subsea electronic module arranged inside a housing, wherein the method comprises: removing the housing and the at least one subsea electronic module; connecting multiplexing/de-multiplexing logic to components of the hydraulic manifold; providing wet mate connectors to the logic; and connecting two separately retrievable subsea electronic modules to the wet mate connectors. This aspect may exhibit the same or similar technical effects and features as the previously described aspects of the invention, and vice versa.

These and other aspects of the present invention will now be described in more detail, with reference to the appended drawings showing currently preferred embodiments of the invention.

FIG. 2 is a schematic side view of a subsea control module (SCM) 10 according to an embodiment of the present invention.

Figure 1:
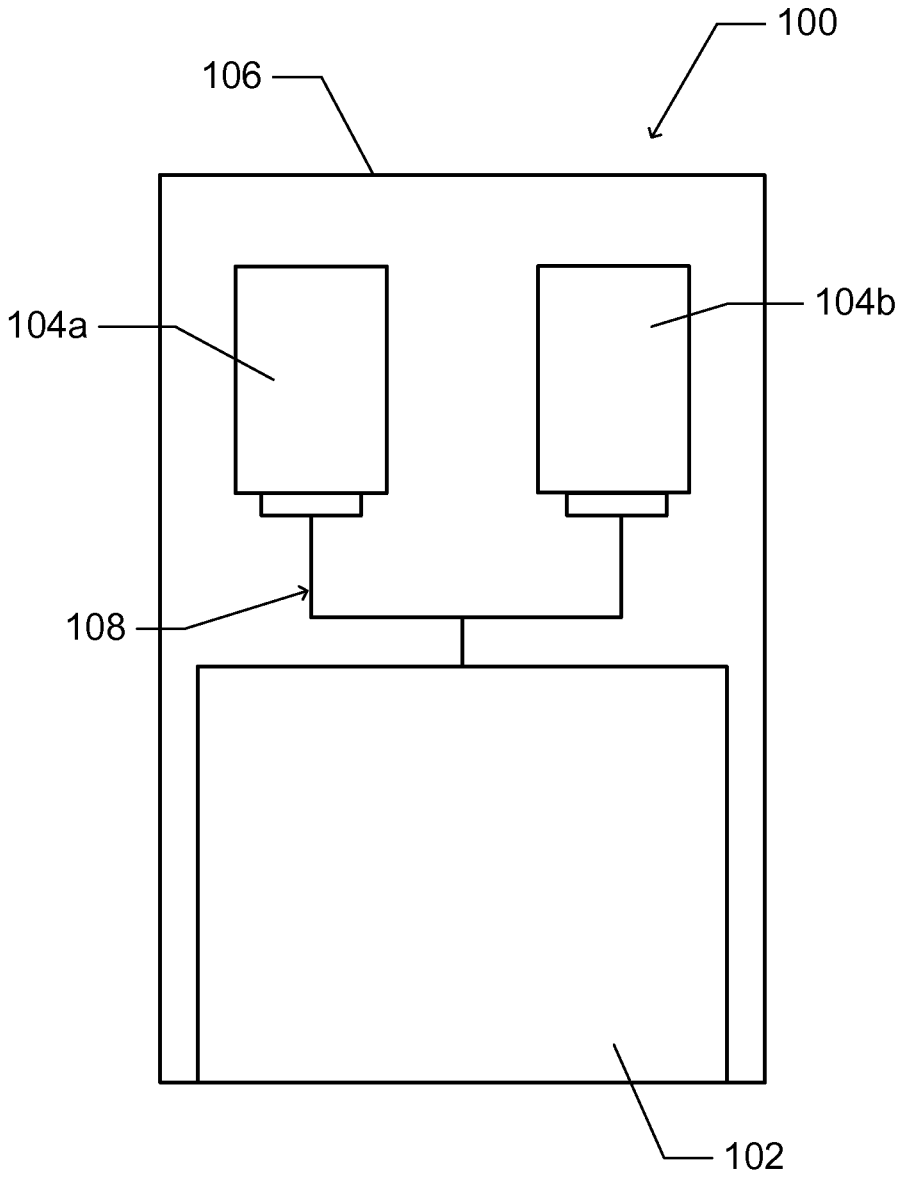
FIG. 1 (prior art)
FIG. 1 is a schematic view of a subsea control module according to prior art.

The SCM 10 comprises an outer housing 12, a hydraulic manifold 14, logics 20*a-b*, wet mate connectors 22*a-b*, and two separately retrievable subsea electronic modules (SEMs) 24*a-b*.

The hydraulic manifold 14 is arranged at least partly inside the outer housing 12. The hydraulic manifold 14 is a metal block with borings for hydraulic fluid. The hydraulic manifold 14 further comprises several components, such as valves 16 and sensors 18. The valves 16 may be directional control valves, which are electrically operated hydraulic valves. The sensors 18 may for example be pressure/temperature transmitter sensors and/or flow meters. The section 19 between the outer housing 12 and the hydraulic manifold 14 may be filled with a dielectric fluid such as oil.

The logics comprise a first logic 20*a* and a second logic 20*b*, one for each subsea electronic module 24*a-b*. The logics 20*a-b* are arranged in or inside the outer housing 12. The logics 20*a-b* may be placed in a pressurized environment. Further, the logics 20*a-b* are preferably made up of discrete circuits. Each logic 20*a-b* is connected to the components, e.g. valves 16 and sensors 18, of the hydraulic manifold 14. The logics 20*a-b* will be described in more detail below.

The wet mate connectors 22*a* and 22*b* are arranged to connect the logics 20*a-b* with the subsea electronic modules 24*a-b*. A wet mate connector is generally a connector that can be connected and disconnected under water. The wet mate connectors 22*a-b* are arranged in or outside the outer housing 12, for example on the top side of the outer housing 12 as in FIG. 2. In an exemplary embodiment, the SCM 10 has two wet mate connectors 22*a* for logic 20*a*/SEM 24*a* and two wet mate connectors 22*b* for logic 20*b*/SEM 24*b*, and each wet mate connector may have twelve pins. An example of a wet mate connector that could be used is the Digitron 12-way connector by Tronic.

Figure 2:
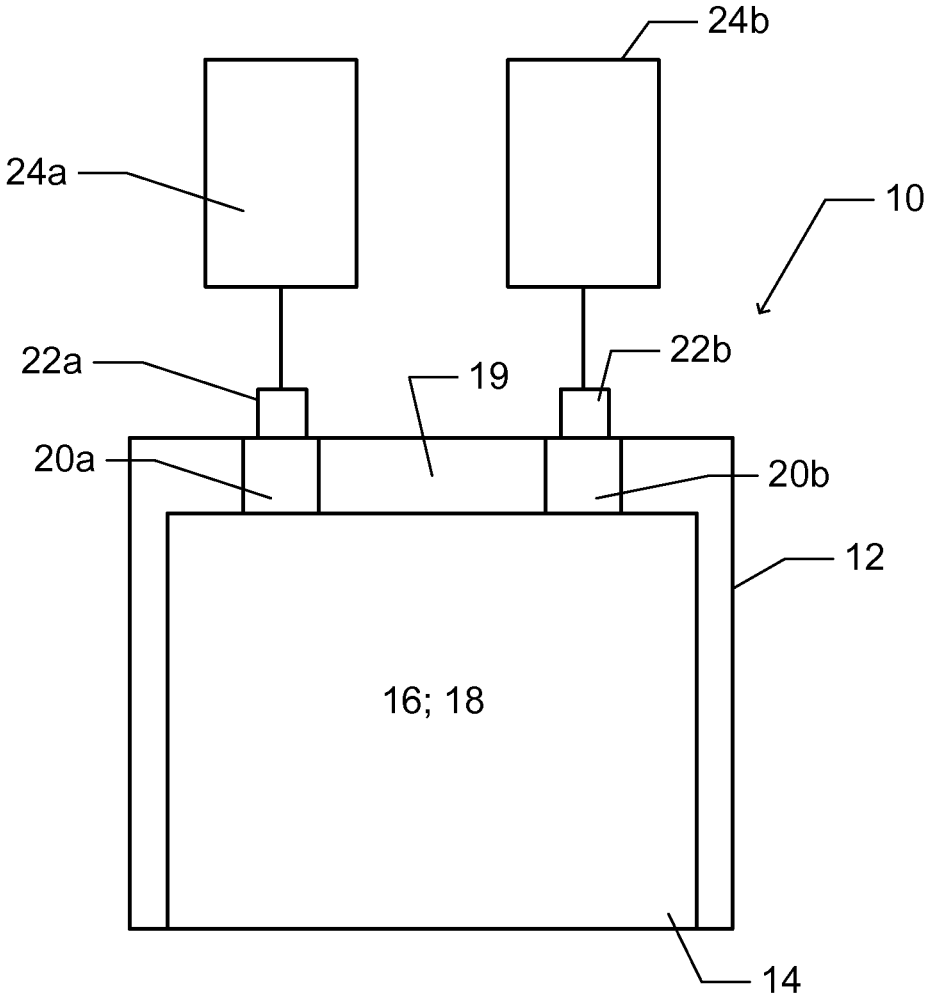
FIG. 2 is a schematic view of a subsea control module according to the present invention.

The subsea electronic modules 24*a-b* are basically the electric part of the SCM 10. The subsea electronic modules 24*a-b* are removably attached to the outside the outer housing 12. The first subsea electronic module 24*a* is connected via the first wet mate connector(s) 22*a*, and the second subsea electronic module 24*b* is connected via the second wet mate connector(s) 22*b*, as shown in FIG. 2. The subsea electronic modules 24*a-b* are preferably adapted for removal and mounting by a remotely operated vehicle (ROV). Each subsea electronic module 24*a-b* may for instance have an ROV bar (not shown) for handling. The two subsea electronic modules 24*a-b* are basically identical.

Hence, the SCM 10 comprises two independent (and typically identical) sub-systems: one with logic 20*a* connected to SEM 24*a* via wet mate connector(s) 22*a*, and one with logic 20*b* connected to SEM 24*b* via wet mate connector(s) 22*b*.

Figure 3:
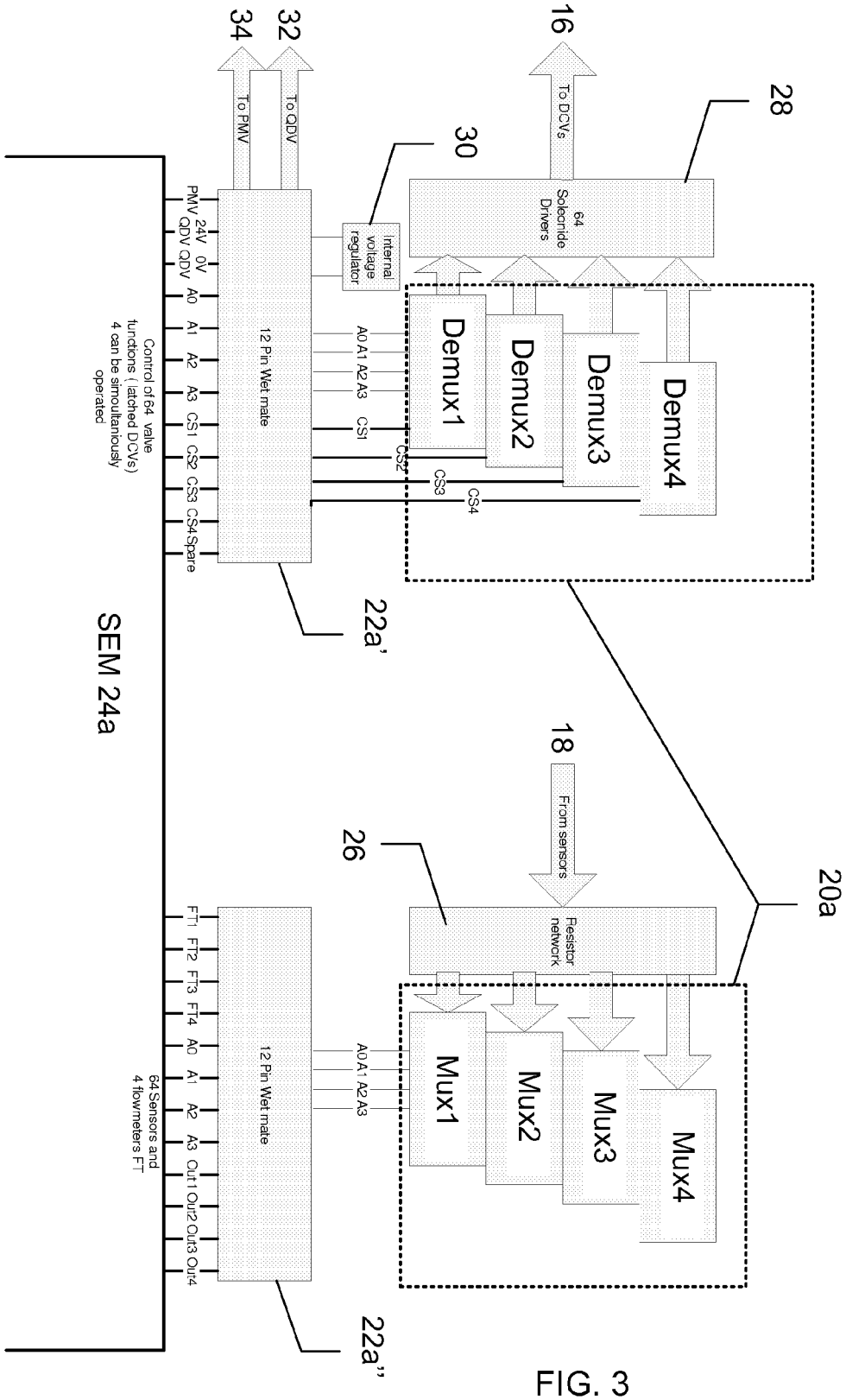
FIG. 3 is a block diagram showing details of an embodiment of the present subsea control module.

The logic 20*a* will now be described in more detail with further reference to FIG. 3. It is appreciated that logic 20*b* may have the same or similar configuration. The logic 20*a* comprises a plurality of multiplexers Mux1-Mux4. On one hand, the multiplexers Mux1-Mux4 are connected to one of the wet mate connectors 22*a* designated 22*a*". On the other hand, the multiplexers Mux1-Mux4 are connected to the sensors 18 via a resistor network 26 used to transform from current (4-20 mA) to voltage (0-5V). The logic 20*a* further comprises a plurality of de-multiplexers Demux1-Demux4.

On one hand, the de-multiplexers Demux1-Demux4 are connected to the other one of the wet mate connectors 22*a* designated 22*a*'. On the other hand, the de-multiplexers Demux1-Demux4 are connected to the valves 16 via solenoid drivers 28. The solenoid drivers 28 may include transistors. The wet mate connectors 22*a*' and 22*a*" are also connected to the subsea electronic module 24*a*. The subsea electronic module may also be directly connected via the other wet mate connector 22*a*' (i.e. not via the logic 20*a*) to at least one of an internal voltage regulator 30, a quick dump valve (QDV) 32, and a production master valve (PMV) or production wing valve (PWV) 34, as shown in FIG. 3. The internal voltage regulator 30 ensures that correct voltage is supplied to the multiplexers and de-multiplexers. The quick dump valve (QDV) 32 is an electrically held safety valve which dumps hydraulic with loss of power.

The multiplexers Mux1-Mux4 are adapted to multiplex several inputs from the sensors 18 to fewer inputs for the subsea electronic module 24*a*. The de-multiplexers Demux1-Demux4 are adapted de-multiplex inputs from the subsea electronic module 24*a* to more outputs for the solenoid drivers 28/valves 16. The (de-)multiplexers could for instance be adapted for frequency-division (de)multiplexing or time-division (de)multiplexing.

A pin allocation example for the present SCM 10 is presented in the tables below:

| Connector 22a' | | Connector 22a" | |
|---|---|---|---|
| Pin | Usage | Pin | Usage |
| 1 | PMV control signal to continuously held DCV | 1 | FT1 Flowtranducer1 |
| 2 | 24 V common supply and QDV supply | 2 | FT1 Flowtranducer2 |
| 3 | Common 0 V return/GND | 3 | FT1 Flowtranducer3 |
| 4 | A0 | 4 | FT1 Flowtranducer4 |
| 5 | A1 Address select line | 5 | A0 Analog select0 selects analog inputs 1-16 |
| 6 | A2 Address select line | 6 | A1 Analog select1 selects analog inputs 17-32 |
| 7 | A3 Address select line | 7 | A2 Analog select2 selects analog inputs 33-48 |
| 8 | CS1 Chip select 1 | 8 | A3 Analog select3 selects analog inputs 49-64 |
| 9 | CS1 Chip select 2 | 9 | Out1 Multiplexed analogue output1 |
| 10 | CS1 Chip select 3 | 10 | Out2 Multiplexed analogue output2 |
| 11 | CS1 Chip select 4 | 11 | Out3 Multiplexed analogue output3 |
| 12 | Spare | 12 | Out4 Multiplexed analogue output4 |

By the above described configuration, 64 directional control valves can be controlled (four at the same time), and 64 pressure transmitter sensors and four flow meters can be read off.

During operation of the SCM 10, (only) one of the subsea electronic modules 24*a-b* may be used, though both subsea electronic modules 24*a-b* could alternatively be used simultaneously. If for example subsea electronic module 24*a* is used, it receives control signals (or data telegrams) via a cable or umbilical from a surface station (not shown). The control signals are processed by the subsea electronic module 24*a*. The processed signals are sent via the wet mate connector 22*a*' to the logic 20*a*. In the logic 20*a*, the signals (input) from the subsea electronic module 24*a* are de-multiplexed by the de-multiplexers, thereby providing an output (control signal) for each valve 16. The output or control signal can for instance be 'open valve' or 'close valve'. The valves 16 in turn operate a plurality of hydraulic devices controlling the subsea hydrocarbon production well to which the SCM 10 is associated. Other signals from the subsea electronic module 24*a* may be sent directly via the wet mate connector 22*a*' to the valve in question, for example signals for controlling the QDV 32 or the PMV/PWV 34. Also, signals (inputs) are generated from the sensors 18. These signals are multiplexed by the multiplexers in the logic 20*a* to fewer signals (inputs), and the multiplexed signals are transmitted via the wet mate connector 22*a*" to the subsea electronic module 24*a*. The subsea electronic module 24*a* may then transmit the signals originating from the sensors 18 to the surface station.

If the subsea electronic module 24*a* is damaged or must to be upgraded or for some other reason needs to be replaced, the subsea electronic module 24*a* is retrieved or removed separately, without having to retrieved the complete SCM 10 from its subsea location. Also, operation of the SCM 10 may continue using the other subsea electronic module 24*b* (and wet mate connector(s) 22*b* and the logic 20*b*). The subsea electronic module 24*a* can for instance be retrieved by an ROV.

Once repaired and/or upgraded, the subsea electronic module 24*a* is brought back and mounted to the SCM 10, again using an ROV. Alternatively, a new subsea electronic module can be mounted to the SCM 10 using the ROV.

A prior art subsea control module as shown in FIG. 1 can also be modified in accordance with the present invention. First, the housing 106 and subsea electronic modules 104*a-b* are removed. Then, multiplexing/de-multiplexing logics 20*a*, 20*b* as described above are connected to components of the hydraulic manifold 102, wet mate connectors 22*a*, 22*b* as described above are provided, and two separately retrievable subsea electronic modules 24*a*, 24*b* as described above may be connected to the wet mate connectors 22*a*, 22*b*. No modification of the hydraulic manifold 102 and its components (valve and sensors) is required. Also the retrievable subsea electronic modules 24*a-b* could be based on existing SEMs 104*a-b*, but with the addition of an I/O card for handling the communication to/from the logics 20*a-b*. The software in existing SEMs and in the surface station needs no modification, since the I/O card is configured to take care of the necessary conversions.

Figure 4:
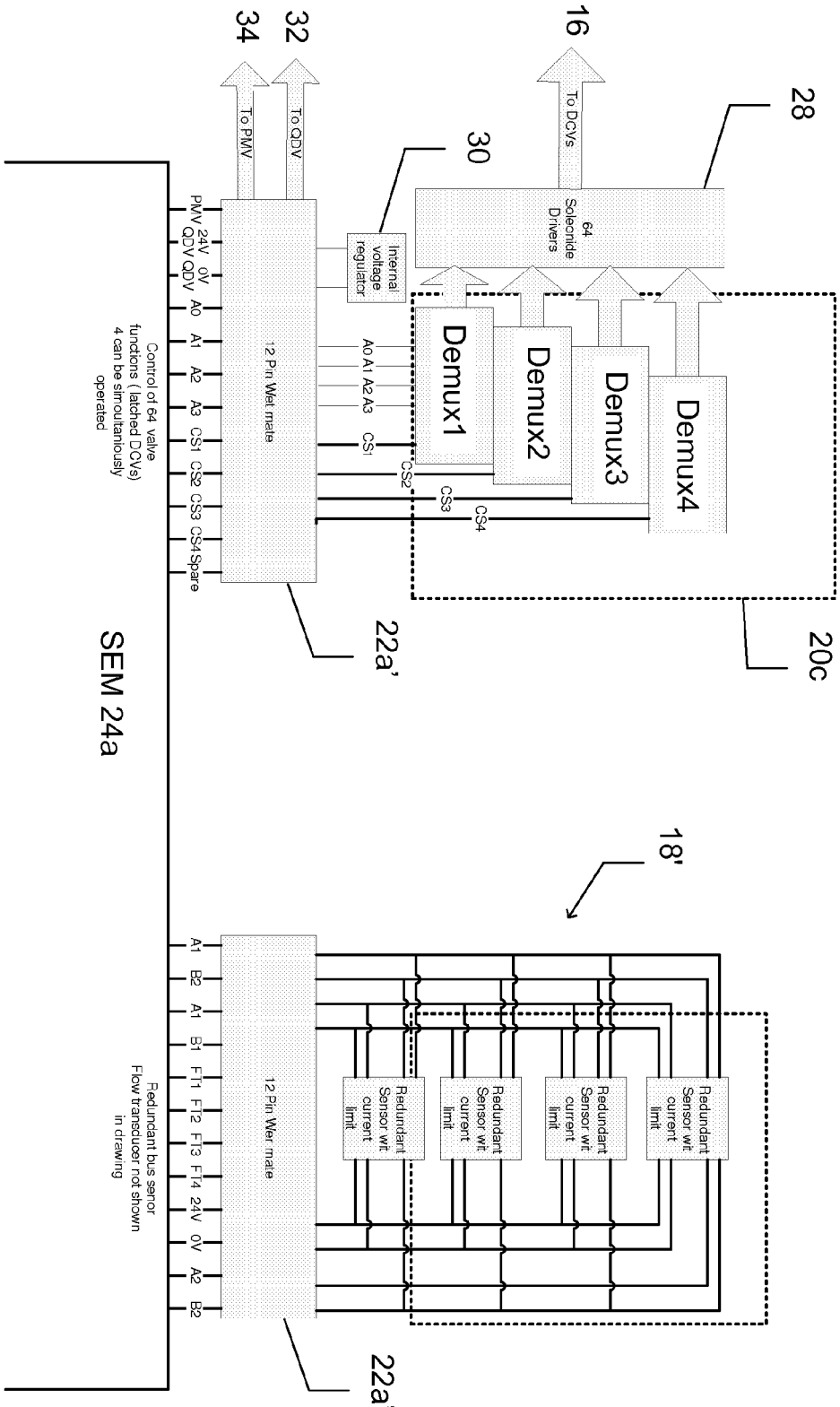
FIG. 4 is a block diagram showing details of another embodiment of the present subsea control module.

In an alternative embodiment illustrated in FIG. 4, the present subsea control module 10 comprises logic 20*c* adapted to de-multiplex signals or data from the subsea electronic modules to components (e.g. valves 16) of the hydraulic manifold. Further, other components of the hydraulic valve includes bus sensors 18' directly connected to the subsea electronic modules via at least one of the wet mate connectors. The logic 20*c* connected to the subsea electronic module, here 24*a*, via a wet mate connector 22*a*'. The logic 20*c* may be the same or similar as the de-multiplexing portion of the logics 20*a-b* previously described, and the communication from the subsea electronic module 24*a* to the various components 16, 32, 34 may also be the same or similar as previously described. However, the bus sensors 18' are directly connected (i.e. not via multiplexing logic as in FIG. 3) to the subsea electronic module 24*a* via another wet mate connector 22*a*". In this embodiment, there are no multiplexers for discrete sensors 16 as in FIG. 3.

The person skilled in the art will realize that the present invention by no means is limited to the embodiment described above. On the contrary, many modifications and variations are possible within the scope of the appended claims. For instance, the SCM 10 could have more than two (separately retrievable) SEMs. Also, the complete SCM 10 could also be retrieved, for example in case of fault in the hydraulic manifold 14.

The subsea electronic modules may be connected by any types of suitable connectors, such as dry mate as well as wet mate connectors.

According to another aspect of the present invention, the subsea control module can been modified from an existing subsea control module, where existing subsea control module comprising a hydraulic manifold (102) with at least two subsea electronic module (104*a*, 104*b*) arranged inside a housing (106) by at least arranging the subsea electronic modules are removably attached outside the outer housing and the hydraulic manifold is arranged at least partly inside the housing.

The invention claimed is:

1. A subsea control module comprising:

a hydraulic manifold;

at least two separately retrievable subsea electronic modules, the two separately retrievable subsea electronic modules each connected by a connector;

an outer housing, wherein the hydraulic manifold is arranged at least partly inside the outer housing, and wherein the subsea electronic modules are removably attached outside the outer housing; and a logic adapted to de-multiplex signals or data from one or both of the subsea electronic modules to components of the hydraulic manifold, wherein the components include a valve and a sensor;

wherein the logic for each subsea electronic module comprises at least one multiplexer adapted to multiplex several inputs from the sensors to fewer inputs for the subsea electronic module, and at least one de-multiplexer adapted to de-multiplex at least one input from the subsea electronic module to more outputs for the valves.

2. The subsea control module of claim 1, configured to operate using only one or both of the two subsea electronic modules.

3. The subsea control module of claim 1, wherein the subsea electronic modules are adapted for removal and mounting by a remotely operated vehicle.

4. The subsea control module of claim 1, wherein the logic is arranged in or inside the outer housing.

5. The subsea control module of claim 1, wherein the logic consists of discrete circuits.

6. A subsea control module comprising:

a hydraulic manifold;

at least two separately retrievable subsea electronic modules, the two separately retrievable subsea electronic modules each connected by a wet mate connector;

an outer housing, wherein the hydraulic manifold is arranged at least partly inside the outer housing, and wherein the subsea electronic modules are removably attached outside the outer housing; and a logic adapted to de-multiplex signals or data from one or both of the subsea electronic modules to components of the hydraulic manifold;

wherein a quick dump valve is directly connected to the subsea electronic module via the wet mate connector, thereby bypassing the logic.

7. The subsea control module of claim 6, configured to operate using only one or both of the two subsea electronic modules.

8. The subsea control module of claim 6, wherein the subsea electronic modules are adapted for removal and mounting by a remotely operated vehicle.

9. The subsea control module of claim 6, wherein the logic is arranged in or inside the outer housing.

10. The subsea control module of claim 6, wherein the logic consists of discrete circuits.

11. A subsea control module comprising:

a hydraulic manifold;

at least two separately retrievable subsea electronic modules, the two separately retrievable subsea electronic modules each connected by a wet mate connector;

an outer housing, wherein the hydraulic manifold is arranged at least partly inside the outer housing, and wherein the subsea electronic modules are removably attached outside the outer housing; and a logic adapted to de-multiplex signals or data from one or both of the subsea electronic modules to components of the hydraulic manifold;

wherein a production master valve or production wing valve is directly connected to at least one of the subsea electronic modules via the wet mate connector, thereby bypassing the logic.

12. The subsea control module of claim 11, configured to operate using only one or both of the two subsea electronic modules.

13. The subsea control module of claim 11, wherein the subsea electronic modules are adapted for removal and mounting by a remotely operated vehicle.

14. The subsea control module of claim 11, wherein the logic is arranged in or inside the outer housing.

15. The subsea control module of claim 11, wherein the logic consists of discrete circuits.

16. A subsea control module comprising:

a hydraulic manifold;

at least two separately retrievable subsea electronic modules, the two separately retrievable subsea electronic modules each connected by a wet mate connector;

an outer housing, wherein the hydraulic manifold is arranged at least partly inside the outer housing, and wherein the subsea electronic modules are removably attached outside the outer housing;

a logic adapted to de-multiplex signals or data from one or both of the subsea electronic modules to components of the hydraulic manifold; and a valve that includes a bus sensor directly connected to one or both of the subsea electronic modules via at least one of the wet mate connectors.

17. The subsea control module of claim 16, configured to operate using only one or both of the two subsea electronic modules.

18. A subsea control module of claim 16, wherein the subsea electronic modules are adapted for removal and mounting by a remotely operated vehicle.

19. A subsea control module of claim 16, wherein the logic is arranged in or inside the outer housing.

20. A subsea control module of claim 16, wherein the logic consists of discrete circuits.

* * * * *